US012553191B2

(12) United States Patent
Taylor et al.

(10) Patent No.: US 12,553,191 B2
(45) Date of Patent: Feb. 17, 2026

(54) FOUNDATION SYSTEM

(71) Applicant: 238 Limited, Suffolk (GB)

(72) Inventors: Paul Taylor, Suffolk (GB); Michael Downing, Suffolk (GB); Geoffrey Whitcher, Suffolk (GB)

(73) Assignee: 238 LIMITED, Ipswich (GB)

( * ) Notice: Subject to any disclaimer, the term of this patent is extended or adjusted under 35 U.S.C. 154(b) by 897 days.

(21) Appl. No.: 17/764,313

(22) PCT Filed: Sep. 25, 2020

(86) PCT No.: PCT/GB2020/052336
§ 371 (c)(1),
(2) Date: Mar. 28, 2022

(87) PCT Pub. No.: WO2021/058980
PCT Pub. Date: Apr. 1, 2021

(65) Prior Publication Data

US 2022/0341100 A1 Oct. 27, 2022

(30) Foreign Application Priority Data

Sep. 27, 2019 (GB) ..... 1913958

(51) Int. Cl.
*E01C 3/00* (2006.01)

(52) U.S. Cl.
CPC ..... *E01C 3/006* (2013.01); *E01C 2201/16* (2013.01)

(58) Field of Classification Search
CPC ... E01C 3/00; E01C 3/006; E01C 5/20; E01C 2201/16

(Continued)

(56) References Cited

U.S. PATENT DOCUMENTS 2,653,525 A * 9/1953 McGuire ..... E01C 9/086 52/577
3,922,409 A * 11/1975 Stark ..... E01C 9/004 428/44

(Continued)

FOREIGN PATENT DOCUMENTS

DE 202018006143 U1 4/2019
EP 2821550 A1 1/2015

(Continued)

OTHER PUBLICATIONS

Combined Search and Exam Report for GB1913958.3 (dated Mar. 10, 2020).

(Continued)

*Primary Examiner* — Gary S Hartmann
(74) *Attorney, Agent, or Firm* — Bond Schoeneck & King, PLLC; Joseph M. Noto

(57) ABSTRACT

A foundation system made up of panels for supporting a load bearing surface on underlying ground in use. Each foundation panel has a panel body having a peripheral edge, first and second opposing major surfaces spaced by a depth dimension of the panel body, and a plurality of internal walls upstanding in the depth dimension so as to define a plurality of cells within the panel. Each cell of the panel is open at one of the first and second major surface and closed at the other of the first and second major surfaces. Connection formations are provided at the peripheral edge of the panel body, where the connection formations comprise a neck portion and a head portion. The head portion is configured to engage with a corresponding connection formation of one or more adjacent panel in use to resist separation of the foundation panel from an adjacent panel in a direction within a plane of the first or second major surface. A support surface may be (Continued)

assembled using multiple foundation panels, each connected to an adjacent panel.

26 Claims, 6 Drawing Sheets

(58) Field of Classification Search
USPC ..... 404/41
See application file for complete search history.

(56) References Cited

U.S. PATENT DOCUMENTS 4,008,548 A * 2/1977 Leclerc ..... E04F 15/02188 428/44
4,584,221 A * 4/1986 Kung ..... E01C 13/045 428/44
D336,348 S * 6/1993 Dorfman, Jr. ..... D25/156
5,992,106 A * 11/1999 Carling ..... E04F 15/105 52/180
7,114,298 B2 * 10/2006 Kotler ..... E01C 5/20 52/592.1
9,051,739 B2 * 6/2015 Rosan ..... E04F 15/105
9,863,155 B2 * 1/2018 Cerny ..... E04F 15/225
10,060,083 B2 * 8/2018 White, Jr ..... E01C 13/08
10,352,002 B2 * 7/2019 Son ..... E01C 5/005
10,895,044 B2 * 1/2021 Penland, Jr ..... E01C 11/222
2004/0226242 A1 11/2004 Moller, Jr.
2004/0258869 A1 * 12/2004 Walker ..... E04F 15/105 428/44
2012/0282440 A1 * 11/2012 Masanek, Jr ..... E01C 5/20 264/241
2019/0211514 A1 7/2019 Jones et al.

FOREIGN PATENT DOCUMENTS

GB 2307260 A 5/1997
WO 02/061206 A1 8/2002
WO 2012/011667 A2 1/2012

OTHER PUBLICATIONS

International Search Report for International Application No. PCT/GB2020/052336 (mailed Jan. 27, 2021).

* cited by examiner

FOUNDATION SYSTEM

This application claims the benefit of International Patent Application No. PCT/GB2020/052336, filed Sep. 25, 2020, which claims priority to Great Britain Patent Application No. 1913958.3, filed Sep. 27, 2019, all of which is hereby incorporated by reference their entirety.

The present invention relates to a foundation system, e.g. for supporting paving or the like.

It can be particularly time-consuming to prepare the ground at a site where it is intended to lay paving or other similar ground coverings. It is well known that uneven ground and/or movement over time can lead to an uneven and unsightly finish to a paved surface. It is an aim to provide a ground-covering support system that can distribute the weight of the paving or the like relatively evenly so that the paving is less prone to movement once installed.

It is conventional to dig an area of ground on which a ground covering is to be installed and to backfill the area with a depth of aggregate, such as crushed stone or the like, that is capable of supporting the ground covering. An adequate depth of aggregate can be in excess of 20 cm and thus requires a significant amount of effort and materials to prepare for the intended ground covering.

Furthermore, the mass of earth that may need to be moved is considerable, often requiring the use of earth moving machinery. In some scenarios, access to a plot of land is only available through a dwelling making it impractical to use machinery on site. As such the task of removing soil and replacing it with aggregate becomes a significant manual undertaking, which risks damage to the dwelling due to ongoing movement of equipment and materials to and from the plot.

EP2066855B1 discloses an interlocking panel base system that is intended for use to support surfaces for sport, amongst other surfaces, such as tiles, hardwood floor, carpet, linoleum or the like. As shown in FIGS. 2 and 3, the system comprises a panel 102 configured to be joined to an adjacent panel 100 to form a substantially continuous floor base structure. The panels are joined by via overlapping tabs 14, 22 through which pins 40 are inserted.

The inventor has found that such systems comprise numerous drawbacks.

A first drawback is that the interface between the adjacent panels formed by the overlapping tabs can undergo an undesirable amount of play or flex in use. This has been found to adversely reduce the communication of load in use from one panel to adjacent panels. For example, one panel can deform relatively easily relative to an adjacent panel once installed, thereby leading to load concentrations in individual panels of the base system, rather than an even load distribution between all panels.

The overlapping tab arrangement also means that each panel may only be disconnected from an adjacent panel by moving the panel in a lateral direction. This may pose issues in a system with many panels, e.g. since, if a panel is surrounded by adjoining panels is damaged and requires replacing, then the surrounding panels must all be removed to allow removal of the damaged panel. In large array, many panels may need to be disconnected just to remove a single panel in the centre of the array, which may be very time consuming.

Once the system of panels are connected, they effectively form a single rigid sheet. This can make the system unwieldy if the system is required to be moved, and therefore necessitates the system be disconnected before moving. Additionally, the rigidity of the sheet may cause localised stress concentrations if the sheet is placed on an uneven surface. This can cause damage to the panels and/or the cause the panels to disconnect, thus creating an uneven surface.

It is an aim of the present invention to overcome or ameliorate one or more of the above problems. It may be considered an additional or alternative aim to provide a ground-covering support structure that allows for even load distribution in use and/or is simple to lay.

According to a first aspect of the present invention there is provided a foundation panel for supporting a load bearing surface on underlying ground in use, the foundation panel comprising: a panel body having a peripheral edge, first and second opposing major surfaces spaced by a depth dimension of the panel body, and a plurality of internal walls upstanding in the depth dimension so as to define a plurality of cells within the panel, each cell being open at one of the first and second major surface and closed at the other of the first and second major surfaces; and, a plurality of connection formations provided at the peripheral edge of the panel body configured to engage with connection formations of one or more adjacent panel in use.

According to a second aspect, there is provided a foundation system comprising a plurality of panels according to the first aspect arranged to be connected in an adjoining, side-by-side arrangement to form a common foundation layer. A male connection formation of one panel may engage with a female connection formation of an adjoining panel.

The first and/or second major surfaces may provide a load bearing surface in use.

The connection formations of the adjacent panels may be engageable, e.g. releasably engageable, in a direction substantially perpendicular to the first and/or second major surface. The connection formations may comprise an abutment or engagement formation to prevent movement of the connection formations away from an aligned condition, e.g. when the adjacent panels are substantially coplanar. The abutment/engagement formation may enable load transfer between adjacent panels in the perpendicular direction.

The connection formations may comprise dovetail-type connection formations. One or more connection formation may comprise a base wall, e.g. to prevent The connection formations may be mounted to the panel body in a resiliently deformable manner, e.g. such that the connection formations can deflect in a plane of the foundation panel in a direction towards and/or away from the panel body.

The connection formations may be mounted to the panel body by one or more arm. The one or more arm may extend in a direction substantially/generally parallel to the peripheral edge of the panel body. The one or more arm may be profiled to permit flexing thereof relative to the peripheral edge.

The connection formation may comprise a retaining/latching member. The retaining/latching member may comprise one or more ridge/protrusion, e.g. which may be configured to engage a corresponding ridge/protrusion or recess in an opposing connection formation of an adjacent panel.

The cells may be provided in a two-dimensional array over an area of the panel. The cells may tesselate.

One or more cells may comprise a web extending therethrough, e.g. a partial wall or reduced-height wall, which may span a lateral dimension of the cell.

The area of cells opening at the first major surface may be approximately equal to the area of the cells opening at the second major surface. The solid surface area or void fraction of the first and second major surfaces may be approximately equal, e.g. over an area of the surfaces in which cells are present.

The connector formation may comprise a female/recess formation and may be closed on one major surface of the panel and/or open on the other major surface of the panel. The female/recess formation may comprise a base wall. The female/recess formation may permit insertion of an opposing male/protruding formation of an adjacent panel from a direction perpendicular to a plane of the panel, e.g. from only one side of the panel.

Practicable embodiments of the invention will be described in further detail below by way of example only with reference to the accompanying drawings, of which:

Figure 1:
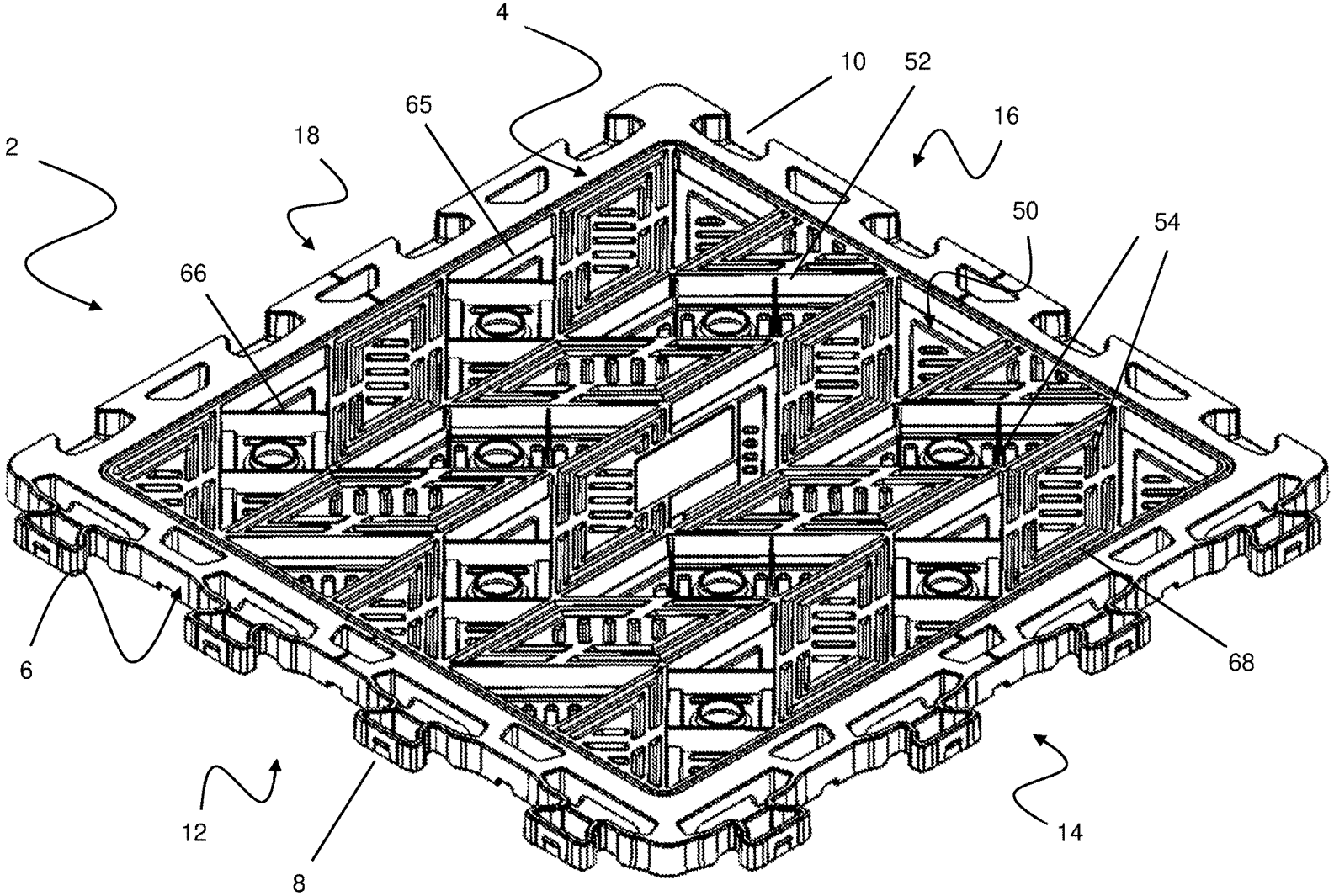
FIG. 1 shows an isometric view of a component of a foundation system.
Figure 2:
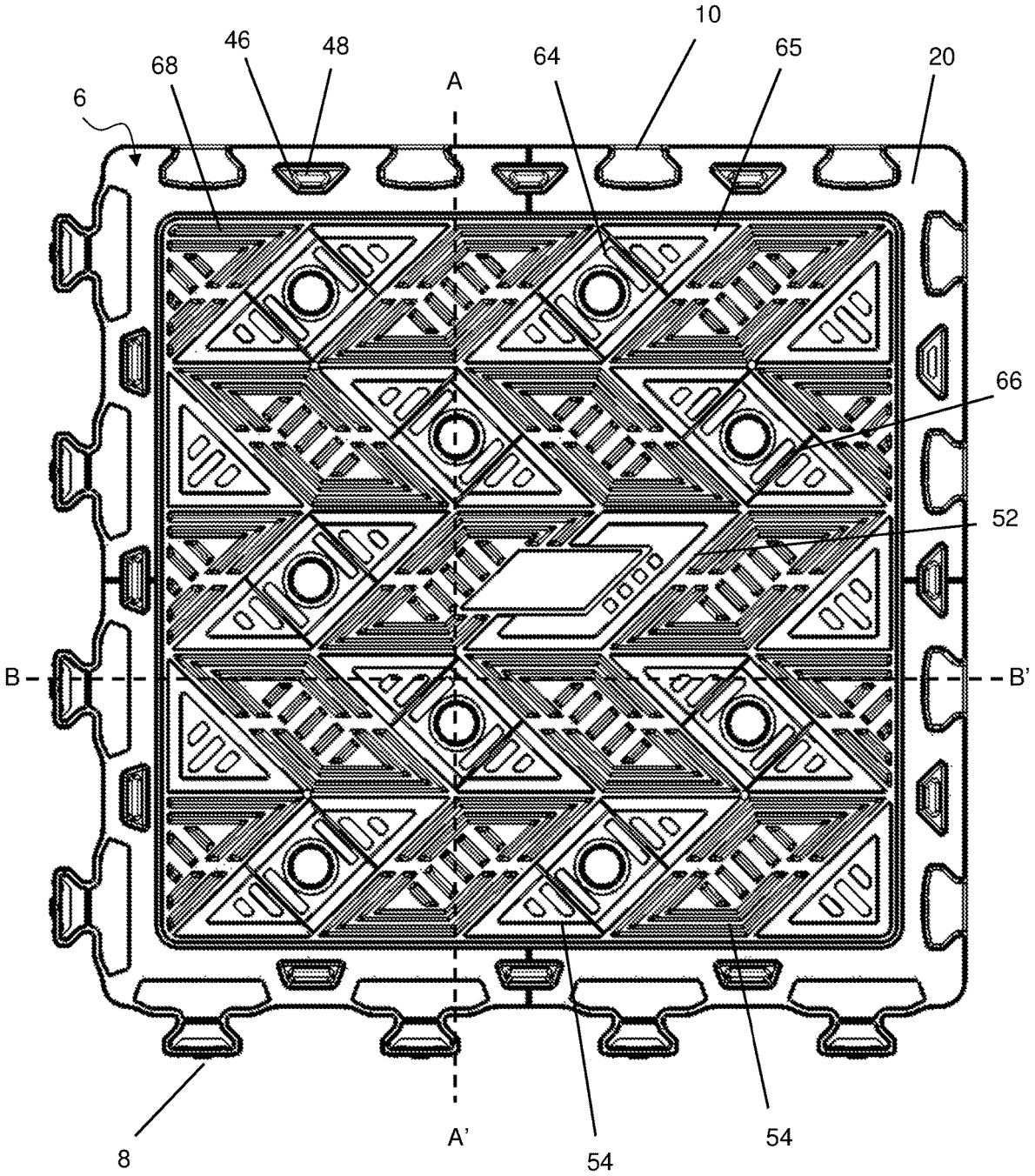
FIG. 2 shows a plan view of the foundation system component.

FIGS. 1 and 2 show a foundation system component in the form of a panel or tile member 2 configured to lie flat on the ground in use to a support an upper surface structure laid atop the panel 2. The panel 2 may thus provide a shallow foundation for building materials placed thereon to provide the desired upper surface, such as paving slabs, decking, brickwork, paneling or other such building materials.

The panel 2 is generally rectangular, e.g. square, in plan, having a central region 4 with a desired profile (to be described below) and a border 6 arranged to provide connection formations around the perimeter of the central region 4. The panel 2 has length and width dimensions that are significantly larger than the panel depth, e.g. being an order of magnitude larger, so as to define a panel that is generally flat. However the panel depth is greater than the wall thickness of the panel material. That is to say the panel is formed of a relatively thin wall material that is profiled to provide the panel with a desired depth and also to provide the mechanical/structural properties of the panel.

The depth of the panel may be greater than or equal to 1, 1.5 or 2 cm. The depth of the panel is typically less than 10, 8 or 6 cm. Any range within these upper and lower limits may be used, depending on the intended lighter/heavier duty use for the panel. It has been found that a panel depth of the order of 2-5 cm is suitable for general paving, decking and similar surface installation, e.g. for domestic or light commercial use.

The length/width dimension of the panel may be greater than or equal to 30, 40, 50 or 60 cm.

The panel border 6 comprises a connection means in the form of connection formations 8, 10 to allow connection to one or more adjacent panel (not shown) of the same type/design. The connection formations 8, 10 are provided at a plurality of sides/edges of the panel. Therefore, a plurality of panels 2 can be joined together at their opposing edges to create a substantially continuous foundation system made up of adjoining panels 2. The connection formations 8, 10 may be equally/uniformly spaced along the edges, e.g. so adjacent panels can be aligned or offset as required.

The connection formations 8, 10 are selectively engageable, to allow connection and disconnection of adjacent panels 2. The shape/size of the foundation system may therefore be assembled to cover a desired area as required. The plurality of connected panels 2 can form a rectangular/polygonal shaped foundation. In other embodiments, the panel 2 could be a different tessellating or non-tessellating shape, for example, a non-rectangular quadrilateral (e.g. a parallelogram), a hexagon or a triangle in plan.

The connection formations 8, 10 of the border 6 are configured to interlock with an adjacent panel. The connection formations comprise a shaped member 8 configured to engage a correspondingly shaped recess 10 (i.e. in an adjacent panel) to provide an interlocking connection therebetween. Adjacent panels can therefore be connected using only the mechanical connection formations integrated into the panels 2, without the use of fasteners or the like.

The connection means comprises a male connector formation 8 and a female connector formation 10 respectively. The male connector formation 8 may otherwise be referred to as a projection and the female connector formation 10 may otherwise be referred to as a recess. The male member 8 is substantially dovetail/wedge/trapezoidal shaped. The female member 10 is substantially dovetail/wedge/trapezoidal shaped, such that the female member 10 can receive the male member 8 in a close-fitting/snug fashion.

The panel 2 comprises a plurality of male connector formations 8 and female connector formations 10. In the example, shown in FIGS. 1 and 2, a plurality of male connector formations 8 are provided on a first side 12 and second (e.g. adjacent) side 14 of the panel 4. A plurality of female connector formations 10 are provided on a third side 16 and fourth side 18 of the panel 4 (e.g. where the third and fourth sides are adjacent). Therefore, one or more sides of the panel 4 only comprises male connection means 8 and one or more other sides of the panel 4 comprise only female connections means 10.

Four male connector formations 8 and four female connector formations 10 are provided along each side with even spacing.

In other embodiments, both male and female connector formations could be provided on a plurality, or all, sides of the panel 2. Alternatively, the panel 2 may only comprise male connector formations (e.g. on each side thereof), and the panel 2 connects to an another panel comprising only female connector formations. However the embodiment of FIGS. 1 and 2 is preferred since it allows a single panel design to accommodate a variety of connection arrangements.

The connection between each adjacent panel is resiliently deformable/flexible to allow resilient/flexible movement between the adjoining panels. When connected, the panels therefore provide a partially flexible foundation, e.g. in which adjoining panels can move/flex relative to one another in the plane of the assembled foundation system. This flexing has been found to be particularly important in relieving internal stresses in use, e.g. due to thermal expansion/contraction and/or creep, as well as relaxing the need for a fixed rigid connection during installation/assembly.

Figure 3:
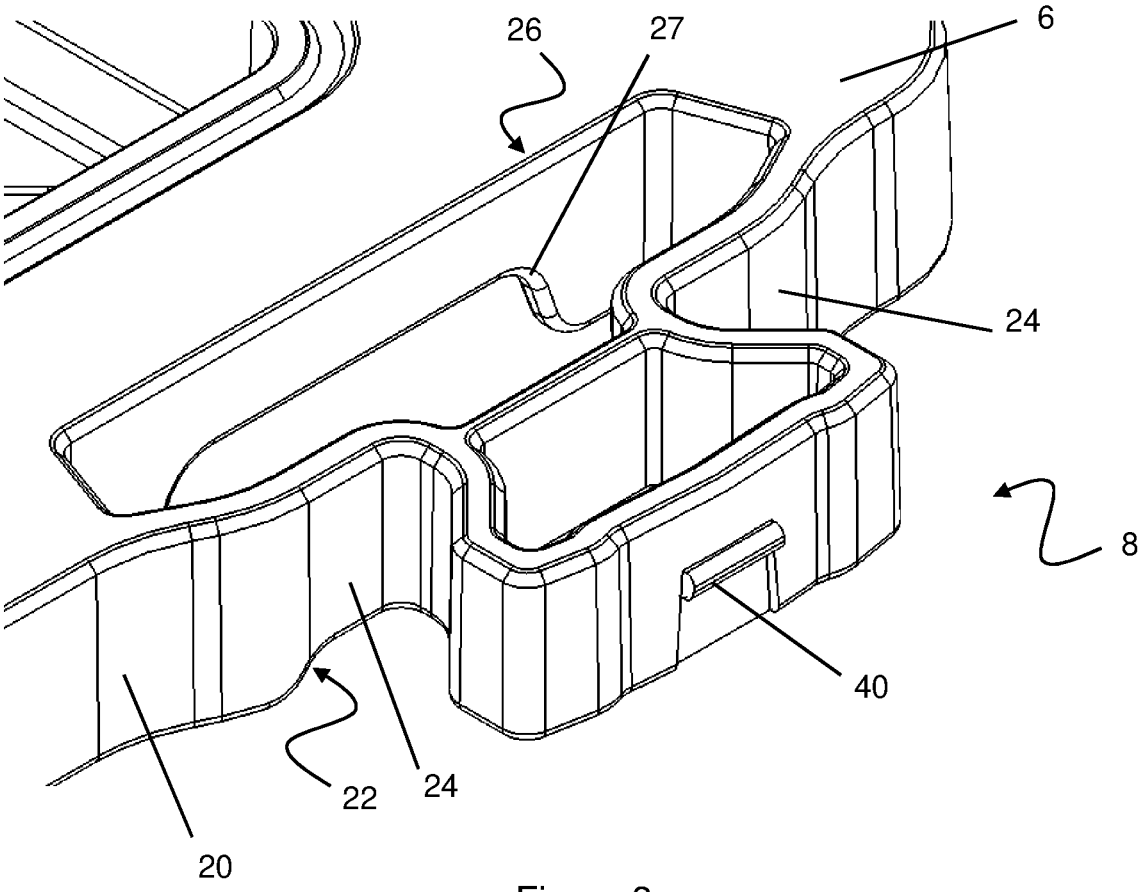
FIG. 3 shows a close-up isometric view of a male connector formation.
Figure 4:
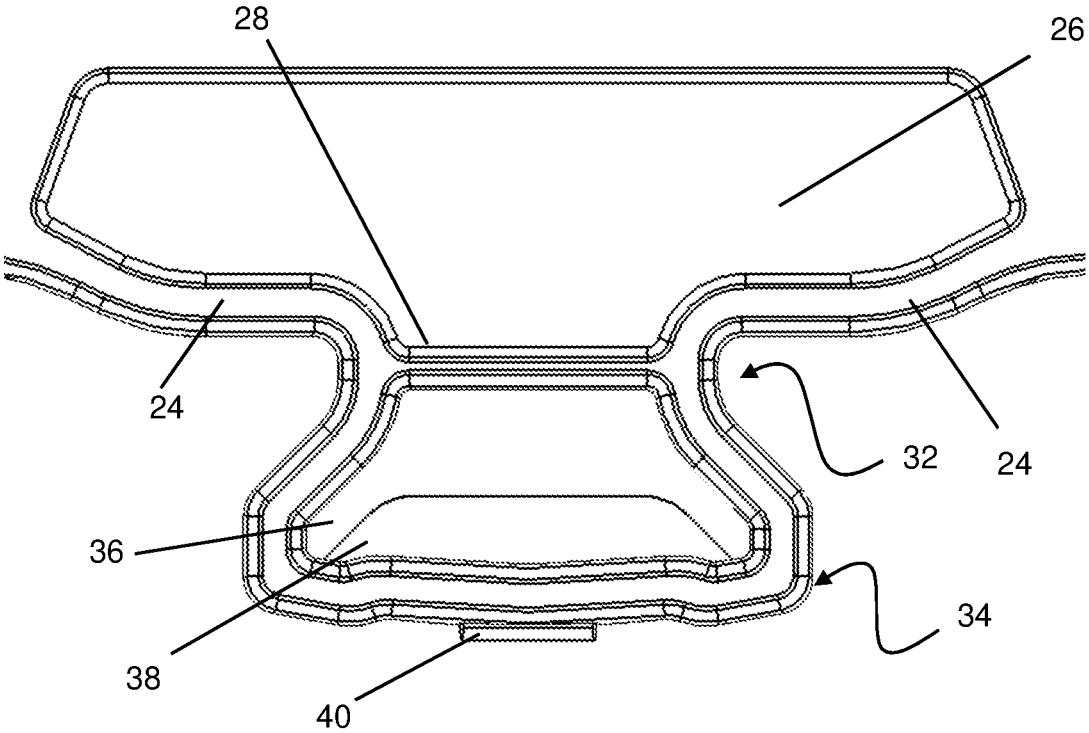
FIG. 4 shows a plan view of the male connector formation.

As shown in detail FIGS. 3 and 4, the male member 8 projects outwardly from the panel. The male member 8 is mounted on the border portion 6 surrounding the panel 4. The border portion comprises a substantially flat surface outer surface or wall 20 extending around the periphery of the border, e.g. to provide a rim around the panel.

The male member comprises a neck portion 32 and a larger/wider head formation 34 as best seen in FIG. 4.

The connection means 6 comprises a spring like formation 22. The spring formation 22 extends between the male member 8 and the panel 2, thereby resiliently mounting the male member 8 to the panel 2, i.e. to the border 6 thereof. The male member 8 is therefore moveable with respect to the panel 2, e.g. in a direction towards and away from the central panel region 4. The male member 8 may thus be resiliently translatable relative to the panel. Additionally or alternatively, the spring-like formation allows a degree of rotation/twist of the male member 8 relative to the panel 2 (e.g. about an axis perpendicular to the plane of the panel).

The spring formation 22 biases the male member 8 to an equilibrium position shown in the figures. Therefore, adjacent panels are biased toward a position where they are commonly aligned. However, the spring formation 22 is configured to allow sufficient flexure/play that the system may adapt to slight misalignments. Additionally, the spring formation 22 may provide flexure to aid in uncoupling of the male and female connection means, when needed.

The spring may comprise a cantilever/leaf spring type arrangement. A plurality arms 24 extend between the male member 8 and the panel 2, e.g. on opposing sides of the neck portion 32 of the male member 8. The flexure of the arms 24 thus provides a biasing force toward the equilibrium position shown in FIG. 3. The arms 24 extend from the rim portion 20 in a direction substantially parallel to the edge/rim of the panel 2. The arms 24 are connected to a respective lateral side of the male member 8 and provide flexure of the male member 8 by a levering action of the arms 24.

The arms are integrally formed with the panel 2 and male member 8, e.g. as a single/unitary component. The arms may have a depth dimension akin to the rim portion 20, e.g. so that the arms permit deflection towards/away from the panel in the plane of the panel but resist deflection out of the plane to a much greater extent.

The arms 24 extend slightly outwards from edge of the rim portion 22 (e.g. being curved away therefrom) part way along their length. At the point the arm 24 connect to the male member 8, the arms 24 extend substantially parallel to the panel rim 20. The arms 24 therefore comprise an oblique inflection (i.e. a flattened out S-shape).

A cavity 26 is provided between the male member 8 and the panel 4, e.g. behind the arms 24, such that the male member 8 can move into the cavity 26 if required (e.g. if adjacent panels are compressed together). The cavity 26 is provided in the rim portion 22. The cavity 26 extends the full length of the arms 24 (i.e. the arms are effectively delimited by the cavity 26). An inner wall of the cavity 26 may comprise a recessed portion 27 to provide a handle arrangement, e.g. for stacking, unstacking and carrying the panels.

Additionally or alternatively, the male member 8 itself may be resiliently deformable. For example, the curved walls of the male member 8 at the neck portion 32 and/or the head portion 34 may provide a spring like effect.

A bridging portion 28 encloses the male member 8 and extends between lateral sides thereof (e.g. at the neck 32). A base plate 36 is provided at a lower end of the male member 8, e.g. thereby providing additional rigidity to the head portion 34. The base plate comprises an aperture 38 therein.

The male member 8 comprises a retaining feature configured to retain the male member 8 within the female member 10. The retaining feature comprises a small projection, such as a tab or ridge, herein referred to as lip 40, projecting from an outer wall of the male member 8. The lip/ridge 40 is resilient and/or resiliently mounted to the male member 8.

Figure 5:
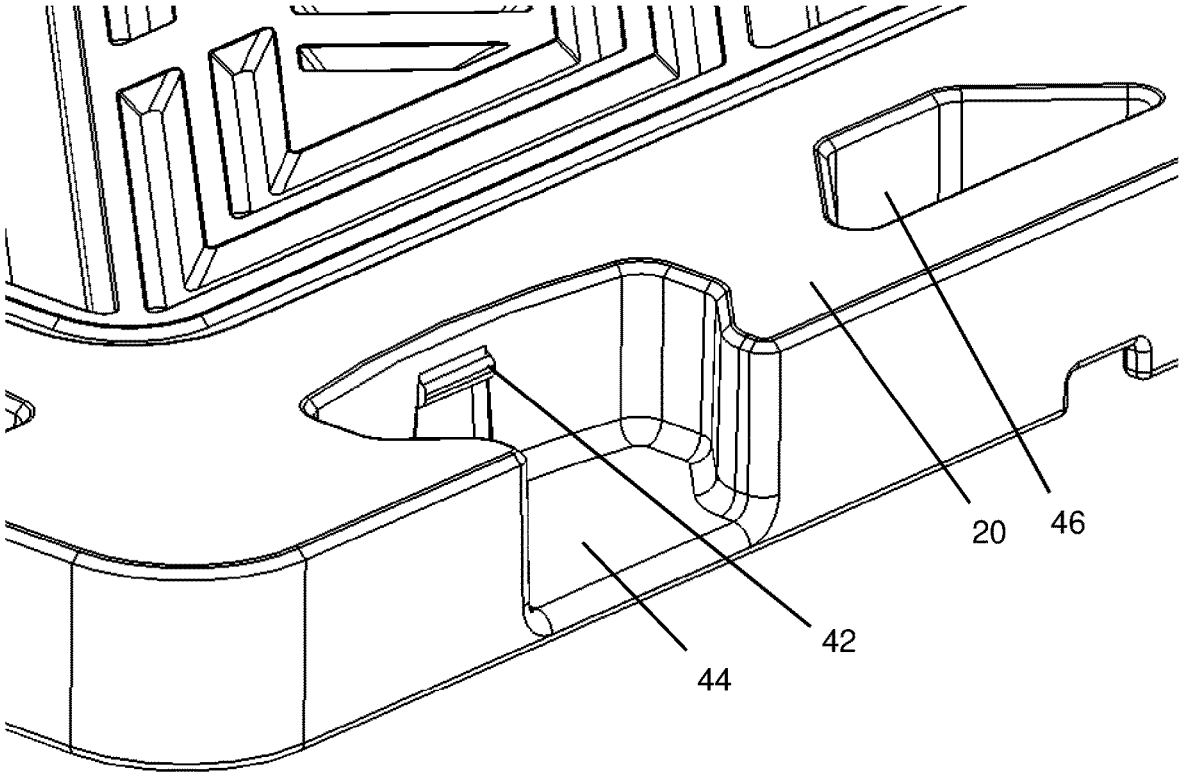
FIG. 5 shows an isometric view of a female connector formation.
Figure 6:
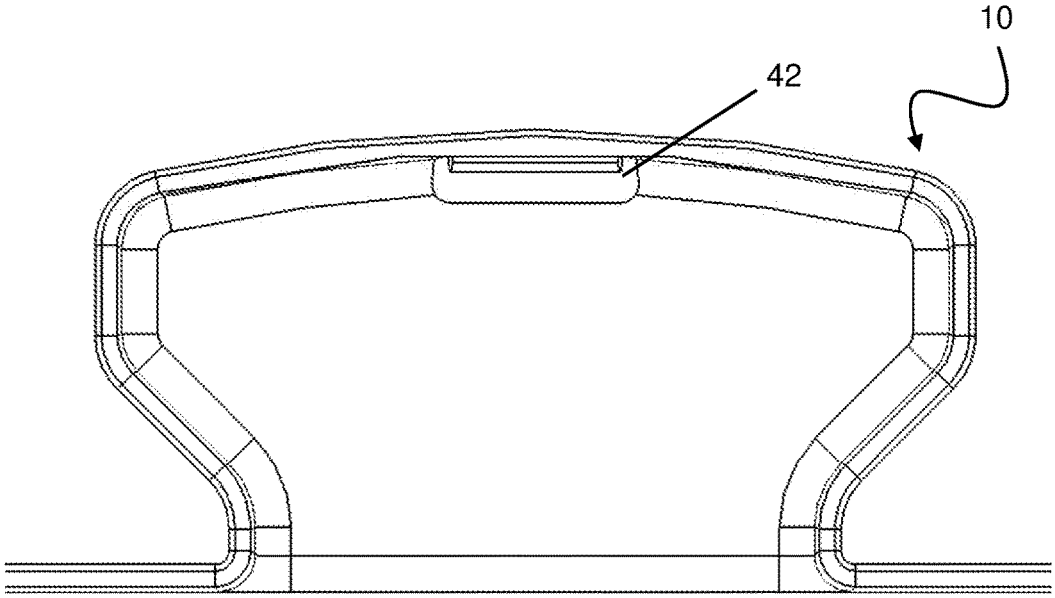
FIG. 6 shows a plan view of the female connector formation.

As shown in FIGS. 5 and 6, the female formation 10 comprises a lip/ridge 42 provided in a corresponding, but slightly elevated position, such that the male lip 40 must pass over female lip 42 upon insertion. Thus the male lip 40 is trapped beneath a lower edge of the female lip 42, thus securing the male member 8 within the female formation 10 recess. The retaining feature thus provides a latch-like connection. The retaining feature can be overcome by manually pulling the male and female formations apart with sufficient force in a direction away from the plane of the adjoining panels but otherwise maintains the male 8 and female 10 connection formations in a connected arrangement. Notably, the shape of the male/female formations prevents pulling apart of the adjoining panels in a direction within the plane of the panels.

In other embodiments, one of the male/female formation comprises a ridge/protrusion/detent which engages (i.e. lies within) a corresponding groove/recess/indent on the female/male member.

FIGS. 5 and 6 show a close up view of the female formation 10. The female formation 10 is recessed inwards from the edge/rim of the panel 2. The female formation is provided within the rim portion 22. It can be seen the female formation 10 comprises a recess corresponding shaped to the male member 8. The female formation has a neck-like opening and a wider recess there-behind.

The female formation 10 comprises a base plate 44 at a lower edge thereof. The base plate 44 provides a base for the male member 8 to sit on. The male member 8, when inserted, is therefore fixed between the base plate 44 and the lip 42.

The rim portion 22 comprises a plurality of recesses 46 therein, e.g. between adjacent female formations 10 along the side of the panel. The recesses 46 comprise a through-hole 48 (see FIG. 2) at a lower end thereof. The recess 46 and/or the through-hole 48 may be trapezoidal in cross-section.

The male and female formations are a close/tight fit. This helps to ensure the coplanar alignment of the panels once connected together. The configuration of male and female connections described above may assist in load transfer between the panels in use Referring back to FIGS. 1 and 2, the central portion 4 of the panel 2 comprises a plurality of cells 50. The cells are adjoining and separated by a plurality of upstanding walls 52, thus defining the boundary of the cells 50. The upstanding walls 52 extend through the depth of the panel 2 from a first/upper side thereof to a second/lower side thereof. The walls 52 are elongate in form, extending in a direction that is parallel/perpendicular with a side of the panel or obliquely angled.

The upstanding walls 52 are internal walls, constrained within the border portion 6. Some walls may extend the full length of the central region 4, e.g. shared by multiple cells 50, whilst others may be constrained to the length of a single cell.

The cells 50 may quadrilateral and/or tessellating. The cells are parallelogram-shaped in plan such that at least some sides/walls of each cell are obliquely oriented relative to the sides of the panel. This can assist with the structural properties of the panel, e.g. its multidirectional strength.

The cells 50 are arranged in a herringbone pattern (i.e. a repeating chevron type pattern) in this example. The cells 50 extend through the panel 4 (e.g. in a direction perpendicular to the plane of the panel 4). The cell walls 52 increase the strength/bending resistance of the panel 4 (e.g. increase the second moment of the area). It is further believed the herringbone pattern further increases strength/bending resistance of the panel 4, particularly in one or more shear and/or non-orthogonal direction.

The cells 50 comprise a face wall 54 configured to substantially close one side of the cell 50. The face wall 54 thus provides a base/floor of the cell when viewed from one side of the panel 2, or a lid/ceiling of the cell when viewed form the other.

Each cell is open to one side of the panel only and closed on the other side. The face wall 54 is provided on alternate sides of adjacent cells 50. Thus approximately half the cells 50 are closed on one side/face of the panel and the other half of the cells are closed on the other side/face of the panel.

Figure 7:
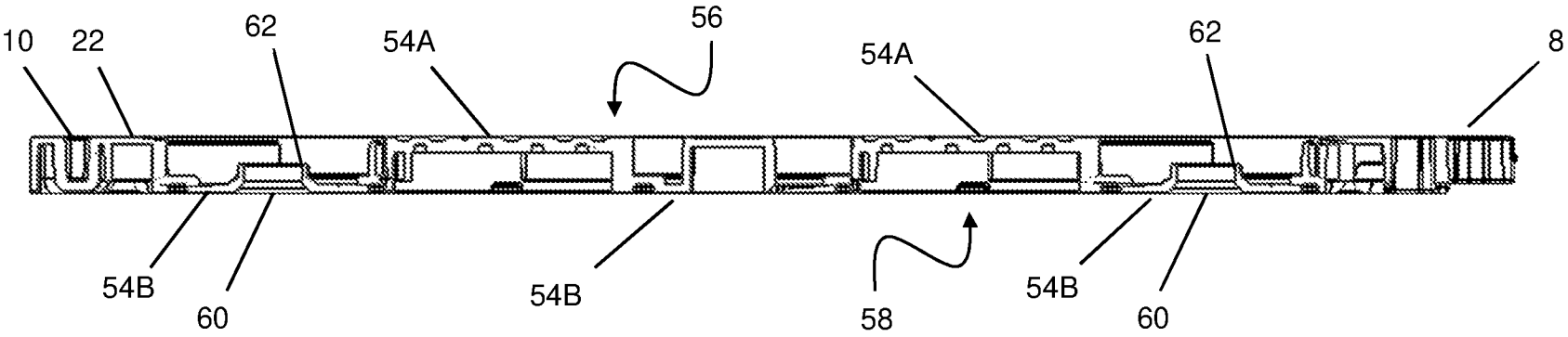
FIG. 7 shows a first section view of the foundation system along the line AA' of FIG. 2.
Figure 8:
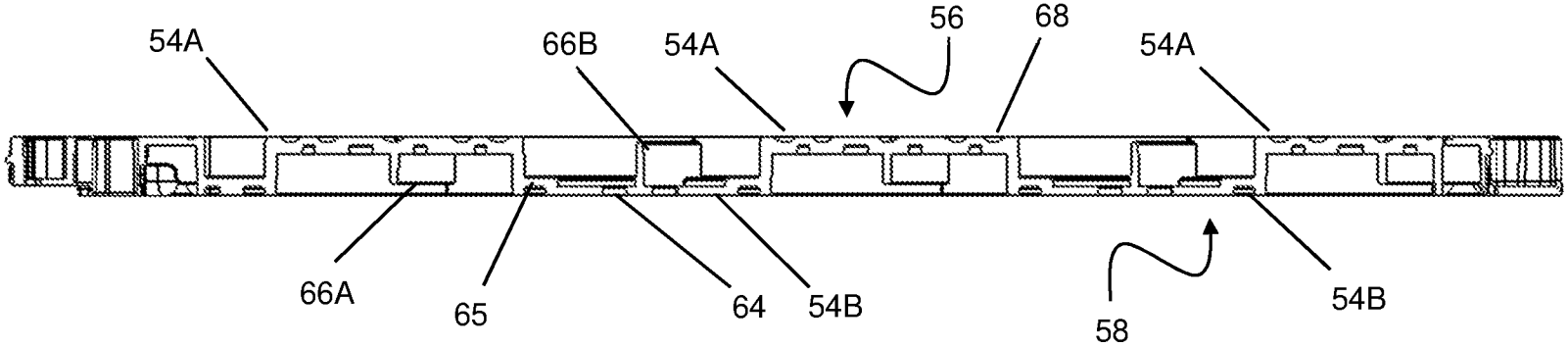
FIG. 8 shows a second section view of the foundation system along the line BB' of FIG. 2.

As best shown in FIGS. 7 and 8, a first portion 54A of the face walls 54 are provided at a first face of the cell 50, and a second portion 54B of the face walls 54 are provided at a second face of the cell 50. Therefore, a portion of the end walls 54A are provided at a first/upper face 56 of the panel 2 and a portion of the end walls 54B are provided at a second/lower face 58 of the panel 2.

In use, the first portion 54A of face walls 54 will contact/face the building materials (e.g. paving slabs, etc.) and the second portion 54B of face walls 54 will contact/face the ground beneath the panel 2.

The cells 50 may be filled with infill (e.g. sand or gravel) in use.

The distribution of the opposing face walls 54A and 54B is substantially even, e.g. so that the surface area on either side of the central region 4 is approximately even on the opposing sides of the panel. The array of face walls 54 is arranged such that adjacent cells 50 have face walls at different length/width positions in the array. For example, a first cell 50 has a face wall 54A at a first side thereof and an adjacent cell 50 has a face wall 54B at the opposing side. The cells therefore provide face walls 54 with an alternating pattern across the panel 4.

The pattern of face walls assures that the load on the panel 2 is distributed well/evenly throughout the panel when laid flat on the ground.

As best shown in FIGS. 1 and 7, the second portion 54B of face walls 54 comprise an aperture 60 extending therethrough. The aperture 60 is configured to receive a stake or the like to allowing pinning of the panel 2 to the ground. The aperture 60 comprises an upstanding rim 62 extending about a periphery thereof.

As best shown in FIGS. 2 and 7, the second portion 54B of face walls 54 may comprise one or more drainage apertures 64 extending therethrough. The drainage apertures 64 are configured to allow water or the like to drain through the panel 2, therefore preventing detrimental build up thereof. The apertures may be elongate and extend substantially perpendicular to the longitudinal axis of the cell 50.

The second portion 54B of face walls 54 comprise an upstanding rim 65 extending around the edge of the cell 50. The drainage apertures 64 are located within the upstanding rim 65.

One or more cells 50 comprise one or more web 66. The web extends laterally across the cell 50. The web 66 may substantially perpendicular to the longitudinal axis of the cell 50 (e.g. parallel with the drainage apertures). One or more web 66 may be provided adjacent an upstanding wall 52, such that the web 66 is an effective continuation of the upstanding wall 52.

The web may be provided adjacent either a first portion 54A or second portion 54B of the face walls (e.g. provided in both types of the cells 50). For example, as shown in FIG. 8, a first web 66A is provided adjacent face wall 54A at an upper side of the cell 50 and a second web 66B is provided adjacent face wall 54B at a lower side of the cell 50. The webs may help to improve the structural rigidity of the panel and also communicate load through the panel structure in use.

Referring back to FIGS. 1 and 2, one or more of face walls 54A comprise grooves/recesses 68 on an outer/upper side thereof. Such formations provide a textured surface for the facing the building materials to be supported thereby in use. The grooves/recesses may extend around the periphery of the face wall 54A or across a mid-portion thereof. Any suitable pattern of ridges/grooves or the like may be provided in order to provide a surface that offers improved surface area and/or features for keying with an adhesive material that may be used to mount the above material layer to the panel 2 in use.

The panel 2 comprising any combination, or all of the features described herein is provided as a single unitary/monolithic component. The panel 2 may therefore be moulded, e.g. using a single moulding process.

The system comprises a polymeric material. The system may manufactured using recycled plastics material.

Figure 9:
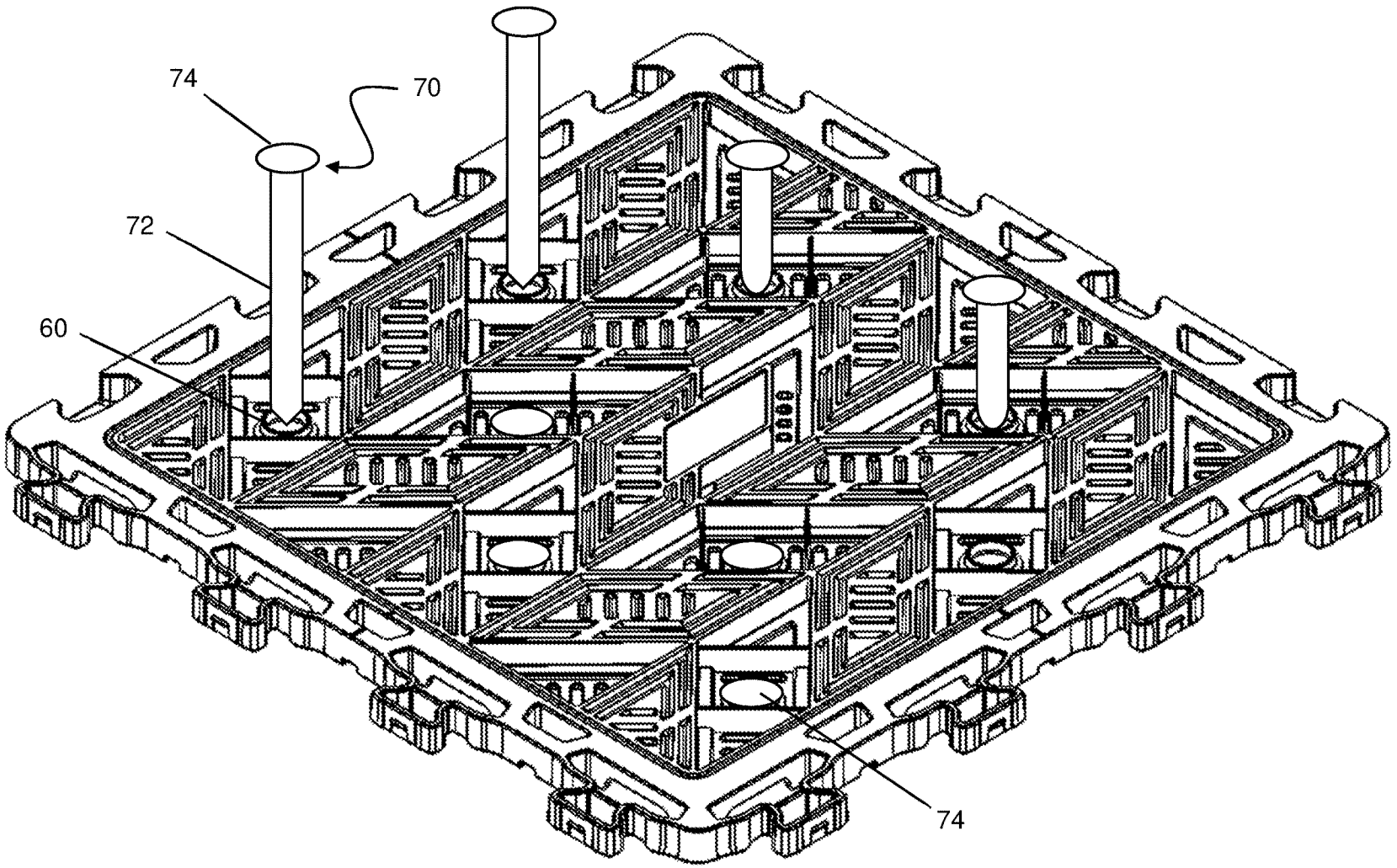
FIG. 9 shows the foundation system component and a plurality of stakes for affixing the component to the ground.

FIG. 9 shows the foundation panel 2 and a plurality of stakes 70 configured to affix the panel 2 to the ground. The stakes 70 comprise shaft portion 72 and a wider head portion 74. The stakes 70 are inserted into the apertures 60 and pushed through the system 2 until the head portion 74 engages the upstanding rim 62.

The stake comprises a plurality of splines extending along the length thereof (not shown). For example, four splines may be provided, thus giving the stake an X-shaped cross-section. The splines may have serrations configured to engage the ground. The serrations may be asymmetric (e.g. a sawtooth configuration), thereby allowing insertion into the ground but preventing removal therefrom.

In use, an area of ground is cleared and prepared for laying as is appropriate. The ground can be roughly flattened/levelled to the extent required. The foundation system will then be laid on the ground by applying each panel 2 in a side by side arrangement over the exposed area of the ground. Each panel clips into one or more existing panel using the connector formations so that the whole foundation system is formed from multiple panels coupled together. The flexibility in the male connector allows some give in the system so perfect panel alignment is not required. Incorrectly laid panels can be easily pulled up and replaced as necessary.

Once panels have been laid, a loose infill material, e.g. sand or other particulate, can be applied to fill the upwardly facing cells of the panel. This has been found to significantly increase the load bearing capacity of the panels in use.

The required top surface materials are laid on top of the foundation system, which may comprise paving slabs, decking, brickwork, paneling or other such building materials. This may be achieved with or without adhesive applied between the panels 2 and the top surface materials. The panel layer is substantially flat to provide a sheet-like foundation arrangement that can improve the distribution of the load applied form above. This means that less ground preparation is required and/or helps to ensure the even nature of the applied surface over time.

The present invention provides a flexible foundation system that is easily transported, handled and installed. Additionally, the system can accommodate uneven ground, without the build up of excessive stress concentrations.

The interlocking nature of the connection means negates the use of pins, fasteners or like the to connect adjacent panels.

The resiliently deformable coupling allows flexible connection to an adjacent panel without the use of complex coupling means (e.g. hinges) which add cost and may easily become corroded or damaged.

Providing only a male or a female connection means on a given side of the panel means the side can be disconnected by merely lifting the side of the panel or the adjacent panel. This negates the requirement to disconnect panels by only lateral movement, and therefore does not require disassembly of the entire system to remove a single panel. Whilst the connector formations allow simple disconnection when being laid, the application of the upper layer of slabs or the like atop the panels in situ effectively locks the connectors together and prevents later separation of the panels.

The cell structure of the panel increases the structural strength and rigidity of the panel. The distribution of the cell face walls allows even load balancing through the panel. The cells provide improved drainage and retention of infill, whilst allow providing sufficient surface area for application of adhesive, if used.

The foundation panel system is intended primarily for external use as a layer applied to the ground, on top of which a solid upper surface layer can be applied. The panel system may be used inter alia for patios, terraces, walkways, driveways, decked areas, ornamental garden surfaces or hardstanding applications.

The invention claimed is:

1. A foundation panel for supporting a load bearing surface on underlying ground in use, the foundation panel comprising:

a panel body having a peripheral edge, first and second opposing major surfaces spaced by a depth dimension of the panel body, and a plurality of internal walls upstanding in the depth dimension so as to define a plurality of cells within the panel, each cell being open at one of the first and second major surface and closed at the other of the first and second major surfaces; and a plurality of connection formations provided at the peripheral edge of the panel body, where the connection formations comprise a neck portion and a head portion, the head portion configured to engage with corresponding connection formations of one or more adjacent panel in use to resist separation of the foundation panel from an adjacent panel in a direction within a plane of the first or second major surface and where the connection formations are mounted to the panel body via one or more resiliently deformable member.

2. A foundation panel according to claim 1, where the resiliently deformable member comprises a cantilever and/or leaf spring member.

3. A foundation panel according to claim 2, where the resiliently deformable member comprises one or more arm extending between the panel body and the connection formation, the arm extending along a portion of the peripheral edge of the panel.

4. A foundation panel according to claim 2, wherein each connection formation is mounted to the panel body using a pair of opposing cantilever arms.

5. A foundation panel according to claim 1, where the connection formations comprise a retaining formation for releasable engagement with the adjacent panel.

6. A foundation panel according to claim 1, where the connection formations are engageable with the corresponding connection formations of the adjacent panel in a direction perpendicular to the plane of the foundation panel.

7. A foundation panel according to claim 1, where a cavity is provided between the panel body and the connection formation, the cavity configured to permit deflection of the connection formation thereinto.

8. A foundation panel according to claim 1, where the panel body comprises a peripheral wall or rim extending around the peripheral edge, each connection formation being provided on the peripheral wall or rim.

9. A foundation panel according to claim 1, where a plurality of upstanding internal walls separate adjoining cells of the plurality of cells within the panel in a side-by-side arrangement.

10. A foundation panel according to claim 1, where at least one of the plurality of the cells opens at the first major surface of the panel body and at last one further cell opens at the second major surface of the panel body such that the cells create recesses in both the first and second major surfaces.

11. A foundation panel according to claim 1, where the connection formations are mounted to the panel body in a resiliently deformable manner, such that the connection formations can deflect in a direction within the plane of the first or second major surface towards and/or away from the panel body.

12. A foundation panel according to claim 1, where the connection formations are configured to releasably engage or lock with corresponding connection formations of an adjacent panel.

13. A foundation panel according to any preceding claim 1, where the connection formations comprise one or more male connection formation configured to be received by one or more female corresponding connection formation on an adjacent panel in use.

14. A foundation panel according to claim 1, where the connection formations comprise one or more female connection formation configured to be received by one or more male corresponding connection formation on an adjacent panel in use.

15. A foundation panel according to claim 13, where the peripheral edge of the panel body comprises two or more sides, one or more of the sides comprising male connection formations and another of the sides comprising female connection formations.

16. A foundation panel according to claim 1, where the connection formations comprise a recess arranged to receive a head portion of a corresponding connection formation of an adjacent panel in use, the recess being open at one of first and second opposing major surfaces and closed on the other of the first and second major surfaces.

17. A foundation panel according to claim 1, where the connection formations depend from the panel body within the plane of the foundation panel.

18. A foundation system, comprising a plurality of foundation panels according to claim 1 arranged to be laid side-by-side in a common plane or layer on the ground such that each panel is adjoining with two or more adjacent panels in the system and the system is arranged to receive a top layer supported on the ground by the plurality of adjoining foundation panels.

19. A foundation panel for supporting a load bearing surface on underlying ground in use, the foundation panel comprising:

a panel body having a peripheral edge, first and second opposing major surfaces spaced by a depth dimension of the panel body, and a plurality of upstanding internal walls spanning the depth dimension so as to define multiple cells within the panel; and, a plurality of connection formations provided at the peripheral edge of the panel body configured to engage with connection formations of one or more adjacent panel in use, wherein the cells are provided in a two-dimensional array over an area of the panel body, a first plurality of the cells in the array being open at the first major surface and closed at the second major surface, and a second plurality of the cells being open at the second major surface and closed at the first major surface.

20. A foundation panel according to claim 19, where the cells are tessellating and polygonal or quadrilateral in shape.

21. A foundation panel according to claim 19, where approximately half of the cells open at the first or major surface and/or approximately half of the cells open at the second major surface.

22. A foundation panel according to claim 19, where at least some of the internal upstanding walls are obliquely oriented relative to the peripheral edge of the panel body.

23. A foundation panel according to claim 19, where the cells are of a non-rectangular parallelogram form and/or where the cells are arranged in a herringbone array.

24. A foundation panel according to claim 19, where the closed sides of the cells form part of the respective first and second major surfaces.

25. A foundation panel according to claim 19, where a closed side of one or more cell comprises one or more aperture therein, e.g. such as a drainage aperture and/or an aperture to receive a stake in use.

26. A foundation panel according to claim 19, where an outward facing surface of a closed side of one or more cell comprises one or more groove or recess to enhance the grip provided by said surface.

* * * * *